United States Patent [19]

Shepard

[11] 4,087,128

[45] May 2, 1978

[54] FOLDING CHAIR

[76] Inventor: Clayton L. Shepard, 824 S. Main St., Bluffton, Ind. 46714

[21] Appl. No.: 823,430

[22] Filed: Aug. 10, 1977

[51] Int. Cl.[2] ..... A47C 4/14

[52] U.S. Cl. ..... 297/52; 297/53

[58] Field of Search ..... 297/52, 53, 47, 46, 297/56, 57, 58, 50

[56] References Cited

U.S. PATENT DOCUMENTS

| | | | |
|---|---|---|---|
| 67,780 | 8/1867 | Mason et al. | 297/53 |
| 141,784 | 8/1873 | Geisler | 297/50 |
| 510,659 | 12/1893 | Walton | 297/53 |
| 545,695 | 9/1895 | Jamme | 297/53 X |
| 991,150 | 5/1911 | Griffith | 297/56 X |
| 1,557,108 | 10/1925 | Tucker | 297/57 X |
| 2,485,156 | 10/1949 | Krenzke | 297/50 |
| 3,885,828 | 5/1975 | Shepard | 297/52 |

*Primary Examiner*—Francis K. Zugel

*Attorney, Agent, or Firm*—Gust, Irish, Jeffers & Rickert

[57] ABSTRACT

A folding chair of the type having generally rectangular, open, inner and outer frames pivotally connected together and nestable one within the other, a seat panel pivotally secured to one of the frames, and a seat back in the form of a generally rectangular open frame which is pivotally secured to one of the inner or outer frames and nestable therewith so that the chair may be folded into a very compact unit of minimum dimensions. In order to provide comfort to the user and additional rigidity to the structure, there is provided a rigid seat back panel pivotally secured along one edge to the seat panel and having its opposite edge removably received in a slot in the upper portion of the seat back frame. When the seat back is pulled forwardly from its fully extended, upright position, the back panel will be pulled out of the slot so that the seat back frame may be passed over the seat panel and folded together with the seat panel and the inner and outer frames.

7 Claims, 10 Drawing Figures

FIG.1
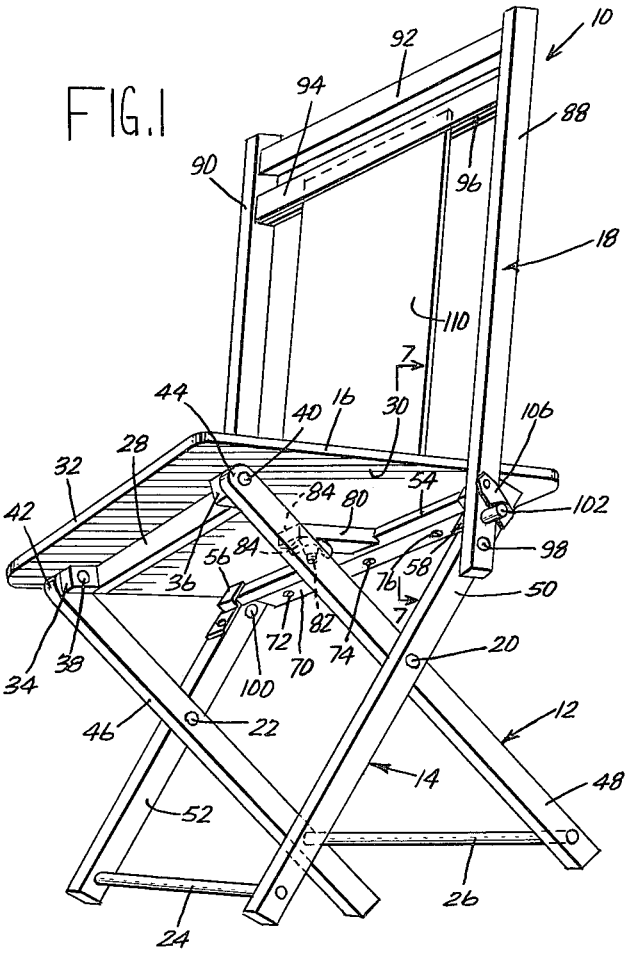
FIG.2
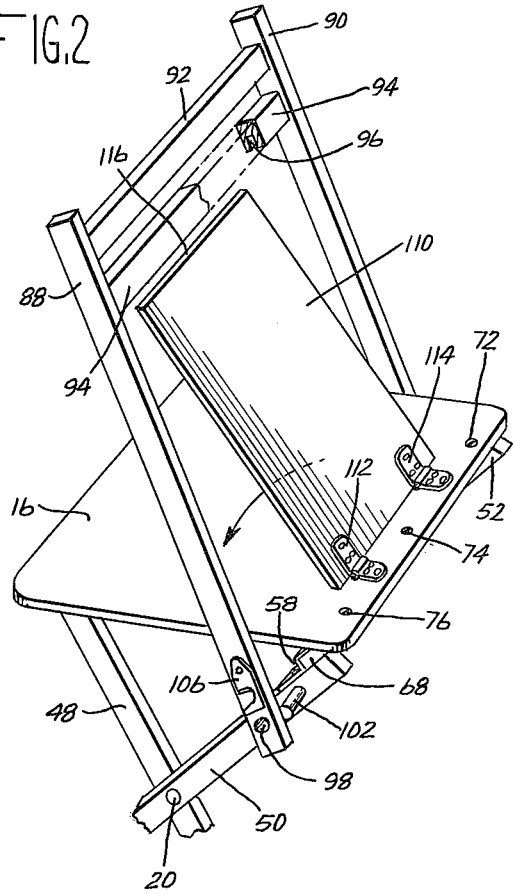
FIG.3
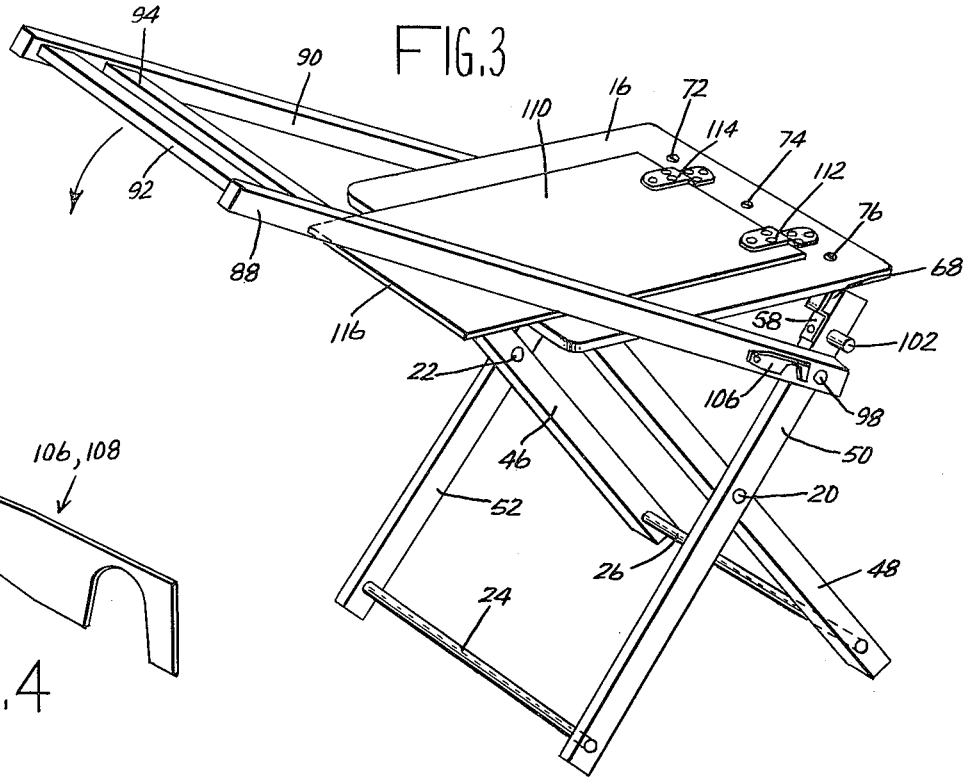
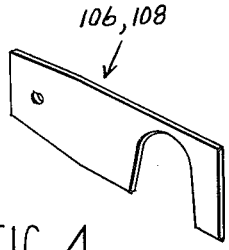
FIG.4

FOLDING CHAIR

BACKGROUND OF THE INVENTION

1. Field of the Invention

The present invention relates to folding chairs of the type in which the legs, back and seat may be folded together to provide a compact unit of minimum dimensions. More particularly, the present invention is concerned with a back panel which may be folded away from the seat back frame so as to permit compact folding of the chair.

2. Description of the Prior Art

Folding chairs are well known. Such chairs typically comprise a plurality of sections which are pivotally connected together to permit folding of the chair for more compact storage. The most common type of folding chair includes a seat back portion which is a fixed extension of one of the leg assemblies. Due to the rigid structure of the seat back panel, however, this type of chair does not provide for maximum compactness when folded. Furthermore, while such chairs may be easily stacked for storage, they tend to be somewhat bulky and awkward to store and transport in compact places such as automobile trunks, campers or the like.

Another type of folding chair is disclosed in U.S. Pat. No. 3,885,828 to the present applicant. This chair includes a seating panel and generally rectangular, open frames forming the legs and seat back thereof. The open frames are pivotally coupled to the seating panel and to one another and are dimensioned to be folded one within the other such that the chair may be folded into a package of minimum dimensions. A plurality of elongated dowels are slidably received in holes through the seat back frame and in holes in the seat panel for the purpose of providing additional support and comfort for persons sitting on the chair. In order to fold the chair, however, the dowels must first be removed and therefore are liable to be lost or damaged.

A further example of prior art folding chairs is shown in U.S. Pat. No. 2,269,777 to Lund. Although this chair has a folding back panel which enables the chair to be more compactly folded, it utilizes relatively thin seat and back panels to permit folding of the seat and back panels in overlapping relationship. This structure is more compact, but results in an inherent loss of rigidity.

In U.S. Pat. No. 719,170 to Zimmerman, a folding chair is disclosed having a generally rectangular open seat back frame which is capable of being folded over the seat panel. No back panel is provided, however, so that structural rigidity and comfort is sacrificed.

SUMMARY OF THE INVENTION

The present invention pertains to a folding chair which overcomes the disadvantages of the prior art in that the seat back includes a rigid center back panel which is capable of being folded over the seat panel so that it may nest with the other frame members and the seat panel in its folded state. This is achieved by providing a back panel which is pivotally secured to the seat and is received within a slot in the upper portion of the seat back frame when the latter is in its fully extended upright position. Due to the fact that the back panel has a shorter radius of rotation than does the seat back frame, the back panel will be pulled out of the slot at a certain point in the forward rotation of the seat back frame. This enables the seat back frame to be folded past the seat panel so that a compact folded unit results.

Specifically, the present invention contemplates a folding chair of the type having a planar seat panel, open and generally rectangular inner and outer frames pivotally connected together and nestable one within the other, the seat panel being pivotally connected to one of the frames near one end of the seat panel, means for connecting the other of the frames to the seat panel near the other end thereof, a seat back including a generally rectangular and open frame pivotally secured to one of the inner or outer frames and nestable with the inner and outer frames, and means for supporting the seat back in a fully extended upstanding position with respect to the seat panel, the seat back frame being rotatable forwardly toward the seat panel from the fully extended position. The improvement in this type of chair comprises: a rigid back panel, capture means on the seat back frame for selectively capturing the back panel, and the means pivotally connecting the back panel to the seat panel such that when the seat back is in its fully extended position, the back panel is capable of being captured by the capture means and held in a position generally coplanar with the seat back frame, but when the seat back frame is rotated forwardly to a given position, the back panel will clear the capture means and the seat back frame such that it is free to rotate relative thereto.

It is an object of the present invention to provide an improved folding chair which has a reinforced seat back when erected and is capable of being folded into a very compact unit for storage.

Another object of the present invention is to provide a chair which may be folded into a very compact unit yet provides a considerable degree of comfort to a person sitting thereon.

A further object of the present invention is to provide a folding chair having a reinforced seat back wherein the leg frames, seat back and seat are pivotally connected together and dimensioned to permit folding to generally coplanar positions.

A still further object of the present invention is to provide a folding chair including latch means for locking the chair in its erected state.

These and other features and objects of the present invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 1 is a perspective view of the folding chair of the present invention in its unfolded state;

FIG. 2 is a fragmentary perspective view of the chair shown partially folded;

FIG. 3 is a perspective view of the chair with the seat back folded further downward than in FIG. 2;

FIG. 4 is an enlarged perspective view of one of the latch elements;

DESCRIPTION OF THE PREFERRED EMBODIMENT

Figure 5:
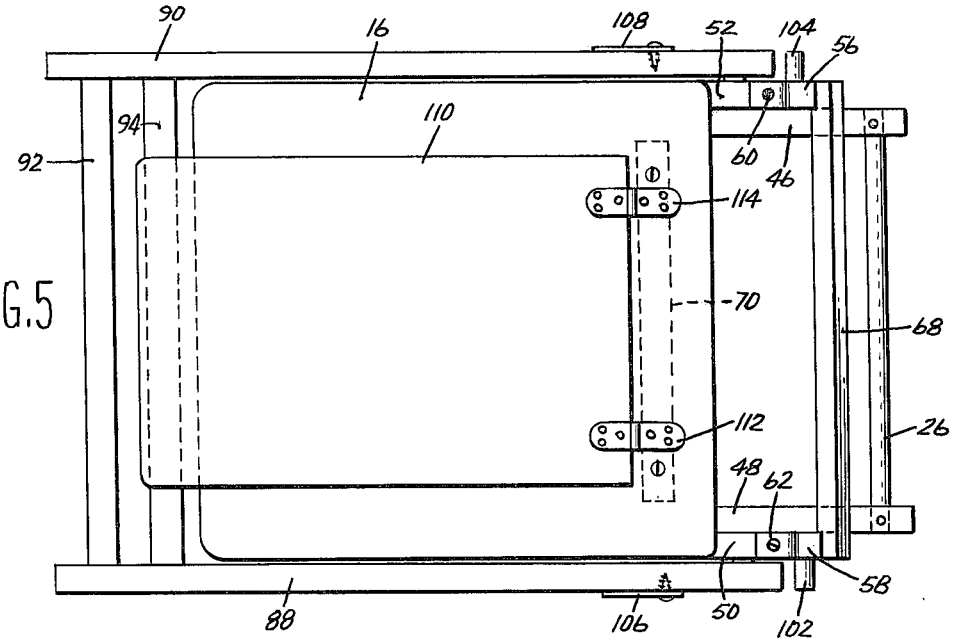
FIG. 5 is a top plan view of the chair in its folded state.

With reference to the drawings, there is shown a folding chair 10 comprising inner leg frame 12, outer leg frame 14, seating panel 16, and seat back frame 18. Inner frame 12 and outer frame 14 are pivotally connected together by means of recessed pins 20 and 22 and are reinforced at their lower ends by dowels 24 and 26. Frames 12, 14 and 18 and dowels 24 and 26 may be made of any suitable material such as wood. Obviously, other materials such as metal or plastic may also be used. Seat panel 16 is generally flat and rectangular and may be fabricated from any suitable material such as plywood. The locations of pins 20 and 22 are such that inner frame 12 and outer frame 14 rotate with respect to each other about an axis colinear with pins 20 and 22.

An elongated hinge mounting block 28 is fixedly secured to the bottom surface 30 of seat panel 16 as, for example, by means of gluing and extends parallel to the forward edge 32. Block 28 has a length less than the width of frame 12 so that frame 12 can be folded flat against the bottom surface 30 of seat panel 16. Pivot blocks 34 and 36 are fixedly secured to seat panel 16 and house hinge pins 38 and 40, respectively, which in turn are pivotally secured to frame 12. Ends 42 and 44 of the individual legs 46 and 48 of inner frame 12 are rounded to facilitate pivoting of frame 12.

Outer frame 14 comprises parallel spaced-apart legs 50 and 52. As best shown in FIGS. 1, 3 and 5, legs 50, 52 are secured together by means of connecting member 54, which may be a wooden block, and L-shaped metal brackets 56 and 58, which are fastened to legs 50 and 52 and connecting member 54 by screws 60 and 62, respectively. Member 54 has one surface 68 which is tapered (FIGS. 2 and 5), the other sides thereof being orthogonal.

Figure 6:
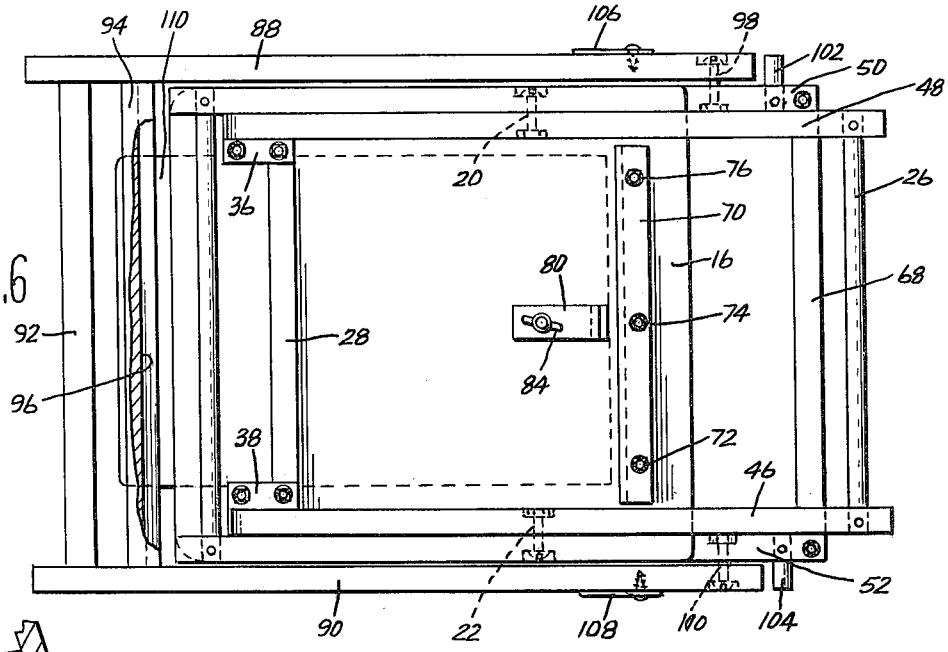
FIG. 6 is a bottom plan view of the chair in its folded state.
Figure 7:
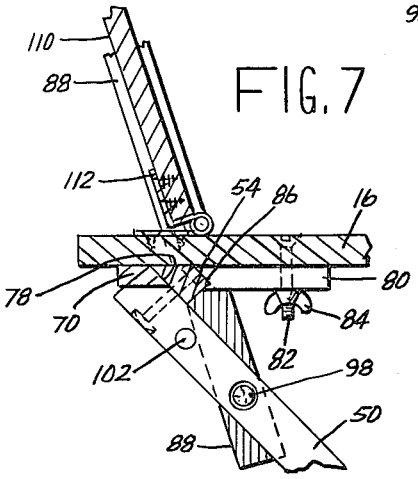
FIG. 7 is a fragmentary sectional view of FIG. 1 taken along line 7—7 and viewed in the direction of the arrows.

Clamping member 70 is fixedly secured to the bottom surface 30 of seat panel 16 by recessed screws 72, 74 and 76. Surface 78 (FIG. 7) of clamping member 70 is tapered such that it receives member 54 in abutting and interlocking engagement therewith. Locking member 80 is pivotally secured to surface 30 by means of bolt 82 and wing nut 84 such that when it is rotated to the position shown in FIG. 1, it abuts member 54. Locking member 80 is provided with V-shaped notch 86 having a shape corresponding to the forwardly facing corner of member 54. With members 54, 70 and 80 in the positions shown in FIG. 1, frames 12 and 14 and seat panel 16 are locked against rotation. Conversely, member 54 can be moved by loosening wing nut 84 and rotating member 80 to the position shown in FIG. 10. With member 80 thus moved, member 54 can be moved out of engagement with clamping member 70 and frames 12 and 14 can be folded one within the other to the positions shown in FIGS. 5 and 6.

Figure 8:
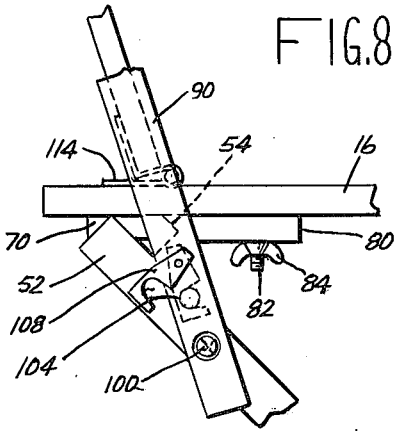
FIG. 8 is a fragmentary side elevational view of the seat back and seat panel connections.

Seat back frame 18 includes a pair of parallel spaced-apart frame members 88 and 90 and a top member 92 rigidly secured to side members 88 and 90 and extending therebetween. A second top member 94 having a slot 96 therein is also rigidly secured to side members 88 and 90. Side members 88 and 90 are spaced apart by a distance approximately equal to the width of seat panel 16 and are pivotally connected to outer frame 14 by pivot pins 98 and 100, respectively. Additionally, the vertical distance between pivot pins 98 and 100 and frame member 94 is such that frame 18 can be rotated forwardly and downwardly past seat panel 16 as indicated in FIGS. 2 and 3. A pair of support dowels 102 and 104 are fixedly secured to outer frame legs 50 and 52 and abut seat back side members 88 and 90, respectively, when frame 18 is in the fully extended position shown in FIG. 1. Latches 106 and 108, which are preferably thin metal strips, hook over dowels 102 and 104, respectively, as shown in FIGS. 1 and 8 so as to prevent seat back 18 from being rotated forwardly when the chair 10 is in use.

Figure 9:
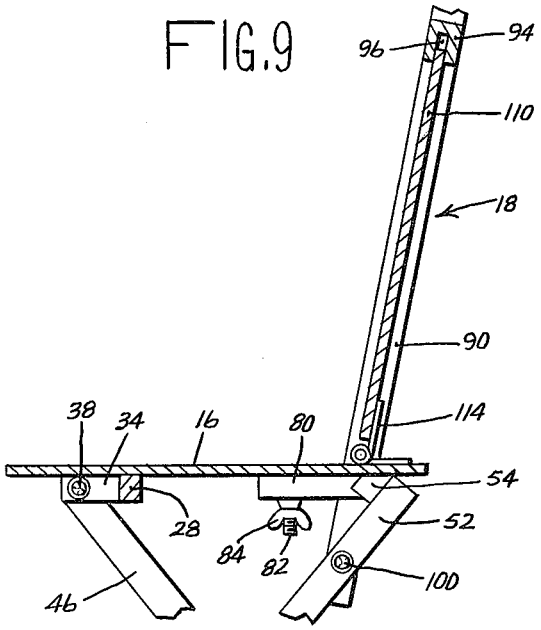
FIG. 9 is a fragmentary side sectional view of the chair in its completely unfolded state.

In order to provide additional rigidity for seat back 18 and to enhance the comfort of the chair 10, a rigid back panel 110 is provided. Panel 110 is pivotally secured to seat panel 16 by hinges 112 and 114 and is dimensioned such that when the chair is in the fully extended position (FIGS. 1 and 9), its upper edge 116 is received in slot 96. As shown in FIG. 9, back panel 110 is generally coplanar with seat back 18 in this position, and the axis of rotation of hinges 112 and 114 are generally coplanar with pivot pins 98 and 100 and seat back 18. Because the radius of rotation of upper edge 116 about hinges 112, 114 is shorter than that of slot 96 about pivot pins 98 and 100, when seat back 18 is rotated forwardly to the position shown in FIG. 10, upper edge 116 of back panel 110 will clear slot 96 thereby enabling seat back frame 18 to rotate forwardly over seat panel 16 as shown in FIG. 3. Back panel 110 is rotated downwardly in facing abutment with seat panel 16. By dimensioning back panel 110 such that it contacts the top of slot 96 when seat back 18 is fully extended, greater strength and rigidity may be achieved.

Figure 10:
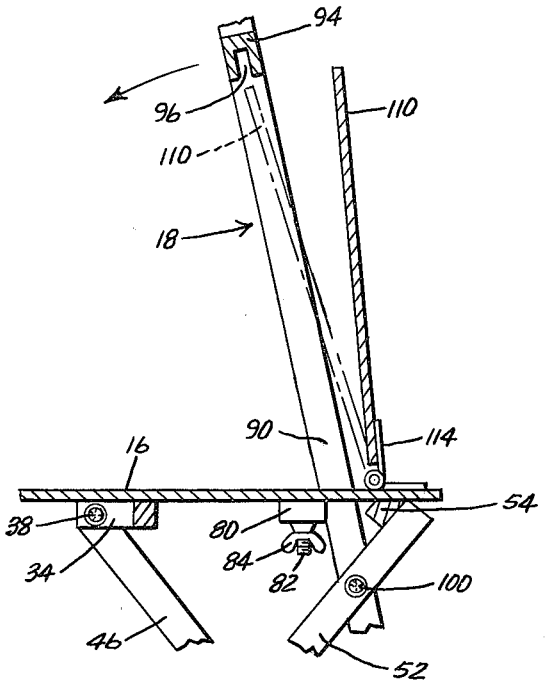
FIG. 10 is a fragmentary side sectional view of the chair wherein the back rest has been rotated forwardly and the back panel is shown in dashed lines to illustrate the geometrical relationship between it and the seat back.

To fold the chair from the fully extended position of FIG. 1, it is first necessary to lift latches 106 and 108 off dowels 102 and 104. Seat back frame 18 is then rotated forwardly as shown in FIG. 10 until back panel 110 clears slot 96. Panel 110 may then be rotated to a position flush with seat panel 16. Seat back frame 18 is then rotated downwardly further until it is generally coplanar with outer frame 14. Wing nut 84 is then loosened and locking element 80 is rotated to the position shown in FIG. 10. This frees element 54 so that it may be moved out of engagement with clamping member 70. Seat panel 16, inner frame 12 and outer frame 14 are then rotated to the coplanar folded positions shown in FIGS. 5 and 6.

To unfold the chair, inner and outer frames 12 and 14 are opened and element 54 is moved into engagement with clamping member 70. Locking member 80 is then rotated to the position shown in FIG. 1, and wing nut 84 is tightened. Seat back frame 18 is then pulled upwardly to the position shown in FIG. 10 and back panel 110 is guided into slot 96 so that when seat back frame 18 is fully extended (FIG. 9), back panel 110 will be captured by slot 96. Latches 106 and 108 are then rotated over dowels 102 and 104. The chair 10 is now completely unfolded and ready for use.

While there have been described above the principles of this invention in connection with specific apparatus, it is to be clearly understood that this description is made only by way of example and not as a limitation to the scope of the invention.

What is claimed is:

1. In a folding chair of the type having a planar seat panel, open and generally rectangular inner and outer leg frames pivotally connected together and nestable one within the other, said seat panel being pivotally connected to one of said leg frames near one end of said seat panel, means for connecting the other of said leg frames to said seat panel near the other end of said seat panel, a seat back including a generally rectangular and open frame pivotally secured to one of said leg frames and nestable with said inner and outer frames, and means for supporting said seat back in a fully extended, generally upright position with respect to said seat panel, said seat back frame being rotatable forwardly toward said seat panel from said fully extended position, the improvement comprising: a rigid back panel, said seat back frame having a slot therein extending generally parallel to one edge of said back panel for selectively capturing said seat back panel, and means for pivotally connecting said back panel to said seat panel such that when said seat back frame is in said fully extended position, said back panel is captured by and received in said slot and held in a position generally coplanar with said seat back frame, but when said seat back frame is rotated forwardly to a given position, said back panel will clear said slot and said seat back frame such that it is free to rotate relative thereto.

2. The folding chair of claim 1 wherein said means for pivotally connecting said back panel to said seat panel includes a hinge generally in the plane of said seat back frame.

3. The folding chair of claim 1 wherein: said back panel has a pair of opposite edges, said means for pivotally connecting said back panel to said seat panel includes a hinge on one of said edges and said hinge has an axis of rotation, the other said edges is capable of being received in said slot when said seat back is in said fully extended position, said the other of said edges being spaced from said hinge axis of rotation by a first radius, and including a pivot connecting said seat back frame and the said one of said leg frames having an axis of rotation spaced from said slot by a second radius, said second radius being greater than said first radius.

4. The folding chair of claim 3 wherein said hinge axis of rotation is generally coplanar with said seat back frame when said seat back frame is in said fully extended position.

5. The folding chair of claim 1 having a folded state wherein said leg frames, said seat back frame, said seat panel and said back panel are generally coplanar.

6. The folding chair of claim 1 including at least one latch means associated with said seat back frame and one of said leg frames for locking said seat back frame in said fully extended position.

7. The folding chair of claim 6 wherein said latch means includes a dowel on one of said leg frames and a hook pivotally attached to said seat back frame, said hook being fabricated of thin metal strip.

* * * * *